US010986910B2

(12) United States Patent
Kim

(10) Patent No.: US 10,986,910 B2
(45) Date of Patent: Apr. 27, 2021

(54) COSMETIC CONTAINER FOR PREVENTING MIRROR FROM BEING CONTAMINATED

(71) Applicant: AMOREPACIFIC CORPORATION, Seoul (KR)

(72) Inventor: Jun Young Kim, Seoul (KR)

(73) Assignee: AMOREPACIFIC CORPORATION, Seoul (KR)

( * ) Notice: Subject to any disclaimer, the term of this patent is extended or adjusted under 35 U.S.C. 154(b) by 463 days.

(21) Appl. No.: 15/566,022

(22) PCT Filed: Apr. 15, 2016

(86) PCT No.: PCT/KR2016/003919
§ 371 (c)(1),
(2) Date: Oct. 12, 2017

(87) PCT Pub. No.: WO2016/171428
PCT Pub. Date: Oct. 27, 2016

(65) Prior Publication Data

US 2018/0110316 A1 Apr. 26, 2018

(30) Foreign Application Priority Data

Apr. 20, 2015 (KR) ..... 10-2015-0055257

(51) Int. Cl.
*A45D 33/00* (2006.01)
*A45D 40/22* (2006.01)
(Continued)

(52) U.S. Cl.
CPC ..... *A45D 40/22* (2013.01); *A45D 33/008* (2013.01); *A45D 33/24* (2013.01); *A45D 40/00* (2013.01);
(Continued)

(58) Field of Classification Search
CPC .... A45D 40/22; A45D 40/00; A45D 40/0068; A45D 40/26; A45D 40/24; A45D 40/222;
(Continued)

(56) References Cited

U.S. PATENT DOCUMENTS 1,479,009 A * 1/1924 Reutter ..... A45D 33/006 132/294
1,612,409 A * 12/1926 Anderson ..... A45D 33/025 132/295
(Continued)

FOREIGN PATENT DOCUMENTS

JP 02-31058 Y2 8/1990
JP 03-55383 Y2 12/1991
(Continued)

OTHER PUBLICATIONS

Dialog/ProQuest Translation of KR 20-0475971-Y1 (Jan. 12, 2015) (Year: 2015).*
(Continued)

*Primary Examiner* — Rachel R Steitz
(74) *Attorney, Agent, or Firm* — Heedong Chae; Lucem, PC

(57) ABSTRACT

The present invention relates to a cosmetic container for preventing a mirror from being contaminated, which includes an outer container (10) having an open upper portion, an outer container cover (20) coupled to one side of the outer container (10) and having a mirror (22) attached to an inner side thereof, an inner container (30) counted in the outer container (10), and an inner container cover (60) coupled to one side of the inner container (30) to seal the inner container (30). The inner container cover (60) has a puff receiving space (63) formed therein as a sidewall surface (62) integrally extends downward from an upper surface (61), a sealing member (66) extends downward from
(Continued)

the sidewall surface (62), and a puff (70) is received in the puff receiving space (63).

5 Claims, 10 Drawing Sheets

(51) Int. Cl.

| | |
|---|---|
| ***A45D 40/00*** | (2006.01) |
| ***A45D 40/26*** | (2006.01) |
| ***A45D 33/24*** | (2006.01) |
| ***A45D 42/02*** | (2006.01) |
| *A45D 34/00* | (2006.01) |

(52) U.S. Cl.
CPC ..... *A45D 40/0068* (2013.01); *A45D 40/26* (2013.01); *A45D 42/02* (2013.01); *A45D 34/00* (2013.01)

(58) Field of Classification Search
CPC ..... A45D 33/008; A45D 33/24; A45D 33/34; A45D 33/006; A45D 33/025; A45D 42/02; A45D 34/00
USPC ..... 132/293, 294, 295, 296, 300, 301, 303, 132/304, 305, 314, 315, 316; 206/210, 206/581
See application file for complete search history.

(56) References Cited

U.S. PATENT DOCUMENTS

| | | | | | |
|---|---|---|---|---|---|
| 1,616,834 | A * | 2/1927 | Vogler | A45D 33/006 | 401/125 |
| 1,672,270 | A * | 6/1928 | Eriksen | A45D 33/006 | 132/294 |
| 2,215,480 | A * | 9/1940 | Sampson | A45D 33/006 | 132/306 |
| 2,527,169 | A * | 10/1950 | Wiggins | A45D 33/006 | 132/293 |
| 3,152,716 | A * | 10/1964 | Feldhahn | B65D 43/163 | 220/230 |
| 7,047,983 | B2 * | 5/2006 | Manougian | A45D 33/006 | 132/294 |
| 7,314,051 | B2 * | 1/2008 | Yuhara | A45D 33/006 | 132/294 |
| 9,210,984 | B2 * | 12/2015 | Byeon | A45D 33/006 | |
| 9,930,952 | B2 * | 4/2018 | Kim | A45D 33/006 | |
| 2007/0029226 | A1 * | 2/2007 | Yuhara | A45D 33/006 | 206/581 |
| 2014/0261530 | A1 * | 9/2014 | McNamara | A45D 33/008 | 132/301 |
| 2014/0283870 | A1 * | 9/2014 | Byeon | A45D 33/006 | 132/315 |
| 2015/0320174 | A1 * | 11/2015 | Kim | A45D 33/006 | 132/295 |

FOREIGN PATENT DOCUMENTS

| | | | | |
|---|---|---|---|---|
| JP | H03055383 | Y2 * | 12/1991 | A45D 33/22 |
| JP | 06-013711 | U | 2/1994 | |
| KR | 20-0473573 | Y1 | 7/2014 | |
| KR | 20-0475971 | Y1 | 1/2015 | |
| KR | 200475971 | Y1 * | 1/2015 | A45D 34/00 |

OTHER PUBLICATIONS

Dialog/ProQuest Translation of KR 20-0473573-Y1 (Jul. 3, 2014) (Year: 2014).*
Dialog/ProQuest Translation of JP 06-013711-U (Feb. 22, 1994) (Year: 1994).*
Dialog/ProQuest Translation of JP 02-31058-Y2 (Aug. 22, 1990) (Year: 1990).*
Dialog/ProQuest Translation of JP 03-55383-Y2 (Dec. 10, 1991) (Year: 1991).*

* cited by examiner

-- PRIOR ART --

COSMETIC CONTAINER FOR PREVENTING MIRROR FROM BEING CONTAMINATED

CROSS-REFERENCE TO RELATED APPLICATION

This application claims the benefit of Korean application No. 10-2015-0055257, filed on Apr. 20, 2015 with the Korean Intellectual Property Office, the disclosure of which is incorporated herein by reference.

Technical Field

The present invention relates to a compact container for preventing a mirror from being contaminated, and more particularly to a cosmetic container for preventing a mirror from being contaminated, which can prevent a cosmetic material from being volatilized by forming an inner container to receive an impregnating member having a gel-phase cosmetic material impregnated therein and a sealing member on an inner container cover hinged with the inner container so that the sealing member is in tight contact with an inner circumferential surface of an outer wall of the inner container, can prevent the mirror from being contaminated as the puff having the cosmetic material remaining therein makes contact with the mirror after the puff has been used, by forming a puff receiving space to receive the puff in the inner container cover, providing a magnet and a magnetic substance in the puff and the puff receiving space to attach the puff to the puff receiving space so that the puff is stored in the inner container cover, thereby storing the mirror formed inside the outer container cover and the puff separately from each other, and can prevent the puff from being hardened by storing the puff in the inner container cover having sealing force.

Background Art

Cosmetics refer to compositions which are used for a human body in order to add charming of the human body by making the human body clean and beautiful, to change the appearance of the human body into being brighter, to maintain skin or hair in a healthy state, or to enhance the skin or the hair, and exert slight effects on the human body.

In general, the cosmetics are obtained by mixing an emulsifier such as a surfactant with cosmetics having a different formulation, and classified into water-in-oil type and oil-in-water type cosmetics depending on the bonding structures of water-phase and oil-phase materials.

The water-in-oil type cosmetic material is obtained by bonding an oil-phase material to an outer portion of the water-phase material. The water-in-oil type cosmetic material contains a great amount of oil, and thus slowly absorbed in the skin, which makes a user feel heavy. However, the water-in-oil type cosmetic material has a long-lasting effect higher than that of the oil-in-water type cosmetic material. Cosmetics required with a higher long-lasting effect are prepared using the oil-in-water type cosmetic material so that water resistance to sweat or water may be enhanced.

In order to overcome the disadvantages of sticky and heavy feeling in the water-in-oil type cosmetic material, the cosmetics are prepared with lower viscosity. However, the lower-viscosity water-in-oil type cosmetics are divided into a water-phase material, which is an inner material, and an oil-phase material, which is an outer material, when being stored in a container for a long time during the distribution. Accordingly, a user must inconveniently use the water-in-oil type cosmetics by shaking a cosmetic container so that the water-phase material and the oil-phase material are mixed with each other.

In order to solve the above problem, the applicant of the present invention has suggested a compact-type container, in which an impregnating member having low-viscosity water-in oil type contents impregnated therein is inserted into an inner container, and a puff used to apply contents is stored at an upper side of an inner container cover, by disclosing Korea Patent Registration No. 10-1159877 as shown in FIG. 1.

However, according to the related art, when a user carries the contact-type container put into the bag of the user, the puff moves to an upper surface of the inner container cover to be in contact with a mirror 1 formed inside an outer container cover, so that the contents remaining on the puff stain the mirror 1. In addition, the contents remaining on the puff are volatilized, so that the puff may he hardened.

DISCLOSURE

Technical Problem

The present invention is suggested in order to solve problems occurring in the related art, and an object of the present invention is to provide a cosmetic container for preventing a mirror from being contaminated, which can prevent a cosmetic material from being volatilized by forming an inner container to receive an impregnating member having a gel-phase cosmetic material impregnated therein and a sealing member on an inner container cover hinged with the inner container so that the sealing member is in tight contact with an inner circumferential surface of an outer wall of the inner container, and can prevent the mirror from being contaminated as the puff having the cosmetic material remaining therein makes contact with the mirror after the puff has been used, by forming a puff receiving space to receive the puff in the inner container cover, providing a magnet and a magnetic substance in the puff and the puff receiving space to attach the puff to the puff receiving space so that the puff is stored in the inner container cover, thereby storing the mirror formed inside the outer container cover and the puff separately from each other.

Another object of the present invention is to provide a cosmetic container for preventing a mirror from being contaminated, capable of preventing a puff from being hardened by storing the puff in an inner container cover having sealing force.

Still another object of the present invention is to provide a cosmetic container for preventing a mirror from being contaminated, capable of fixedly storing a puff by forming a fixing protrusion or a fixing groove in a lateral side of a puff receiving space formed inside an inner container cover.

Still another object of the present invention is to provide a cosmetic container for preventing a mirror from being contaminated, capable of preventing a strap, which is formed on a puff, from making contact with an impregnating member having a cosmetic material impregnated therein to be contaminated by forming a membrane at an inner lower end of a puff receiving space.

Technical Solution

There is provided a cosmetic container for preventing a mirror from being contaminated, which includes an outer container (10) having an open upper portion, an outer container cover (20) coupled to one side of the outer container (10) and having a mirror (22) attached to an inner side thereof, an inner container (30) mounted in the outer container (10), and an inner container cover (60) coupled to one side of the inner container (30) to seal the inner container (30). The inner container cover (60) has a puff receiving space (63) formed therein as a sidewall surface (62) integrally extends downward from an upper surface (61), a sealing member (66) extends downward from the sidewall surface (62), and a puff (70) is received in the puff receiving space (63).

In addition, the inner container (30) is provided therein with an impregnating member (40).

Further, a fixing member (50) is additionally provided on the inner container (30) to prevent an impregnating member (40) from being separated out of the inner container (30).

Further, the puff receiving space (63) of the inner container cover (60) is formed in an upper end thereof with in a magnet installation groove (64), and a magnet (65) is provided in the magnet installation groove (64).

In addition, the puff (70) is provided therein with a magnetic substance (75).

Further, the sidewall surface (62) of the inner container cover (60) is formed in an inner side thereof with a fixing protrusion (621) or a fixing groove (622) to fixedly store the puff (70).

Further, a membrane (67) is formed at a lower end of the puff receiving space (63) of the inner container cover (60) to prevent a strap (71) formed on the puff (70) from being in contact with an impregnating member (40) and contaminated.

Advantageous Effects

As described above, there can be provided a cosmetic container for preventing a mirror from being contaminated, which can prevent a cosmetic material from being volatilized by forming an inner container to receive an impregnating member having a gel-phase cosmetic material impregnated therein and a sealing member on an inner container cover hinged with the inner container so that the sealing member is in tight contact with an inner circumferential surface of an outer wall of the inner container, and can prevent the mirror from being contaminated as the puff having the cosmetic material remaining therein makes contact with the mirror after the puff has been used, by forming a puff receiving space to receive the puff in the inner container cover, providing a magnet and a magnetic substance in the puff and the puff receiving space to attach the puff to the puff receiving space so that the puff is stored in the inner container cover, thereby storing the mirror formed inside the outer container cover and the puff separately from each other.

There can be provided a cosmetic container for preventing a mirror from being contaminated, capable of preventing a puff from being hardened by storing the puff in an inner container cover having sealing force.

Further, there can be provided a cosmetic container for preventing a mirror from being contaminated, capable of fixedly storing a puff by forming a fixing protrusion or a fixing groove in a lateral side of a puff receiving space formed inside an inner container cover.

In addition, there can be provided a cosmetic container for preventing a mirror from being contaminated, capable of preventing a strap, which is formed on a puff, from making contact with an impregnating member having a cosmetic material impregnated therein to be contaminated by forming a membrane at an inner lower end of a puff receiving space.

DESCRIPTION OF DRAWINGS

FIG, 1 is a perspective view showing a cosmetic container according to the related art.

BEST MODE

Mode for Invention

Hereinafter, a cosmetic container for preventing a mirror from being contaminated according to one embodiment of the present invention will be described with reference to accompanying drawings.

Figure 1:
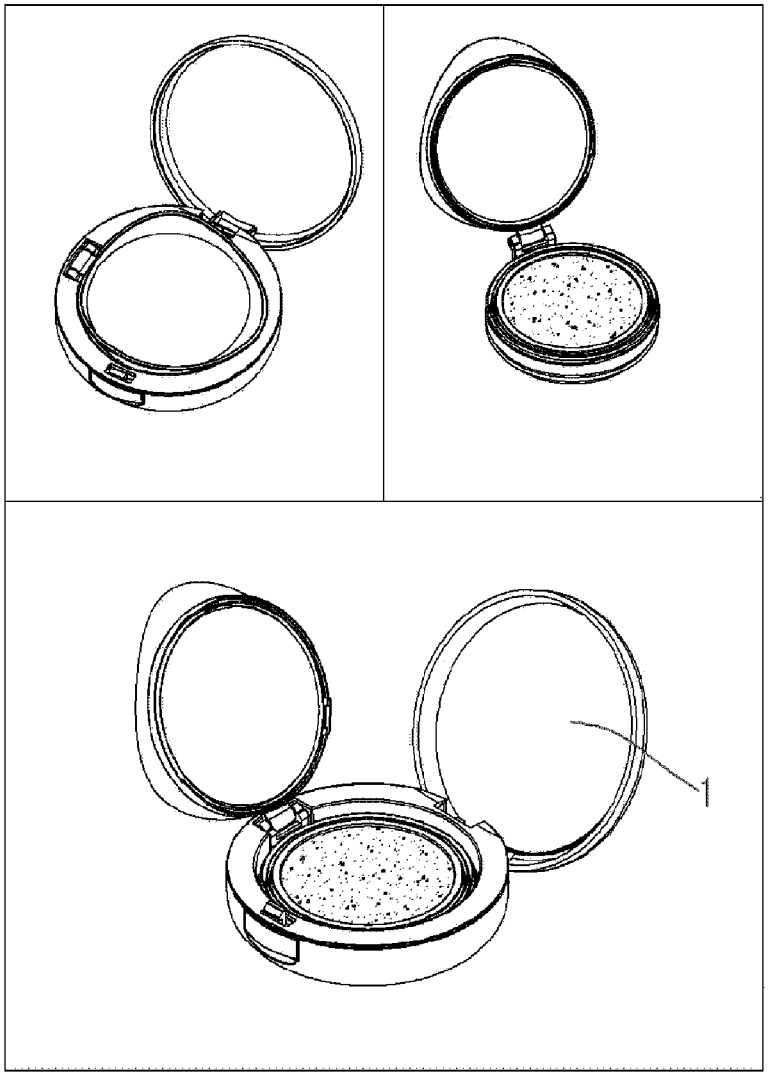
Figure 2:
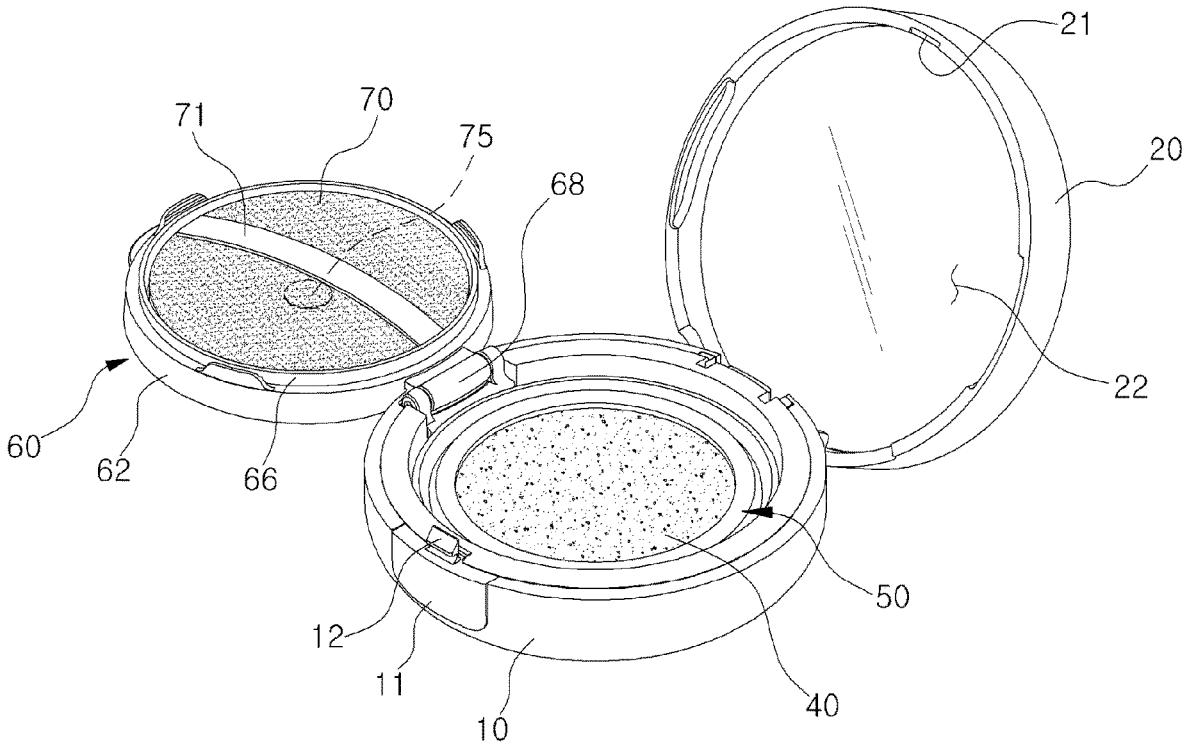
FIG. 2 is a perspective view showing that a cover is open in a cosmetic container for preventing a mirror from being contaminated according to one embodiment of the present invention.
Figure 3:
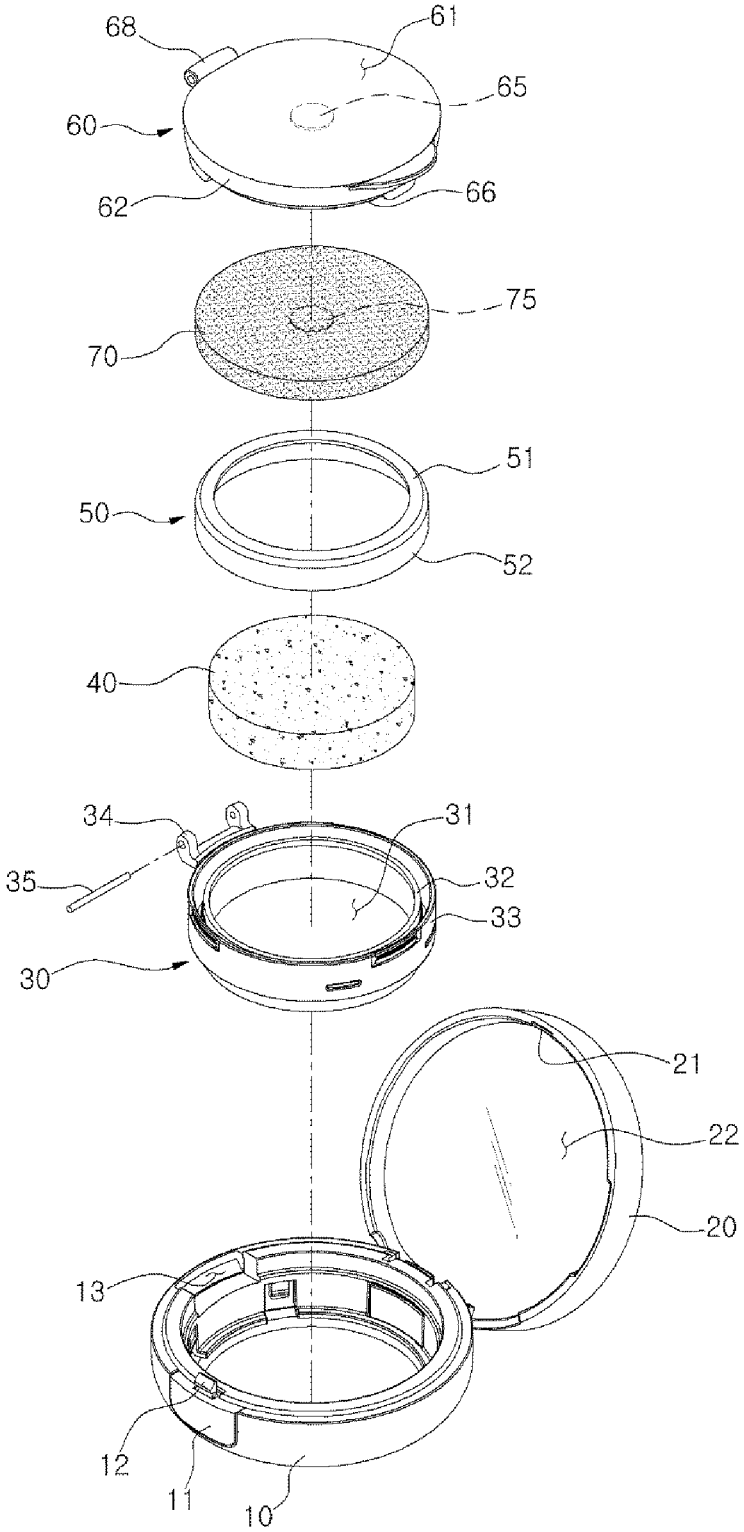
FIG. 3 is an exploded perspective view showing the cosmetic container for preventing the mirror from being contaminated according to one embodiment of the present invention.
Figure 4:
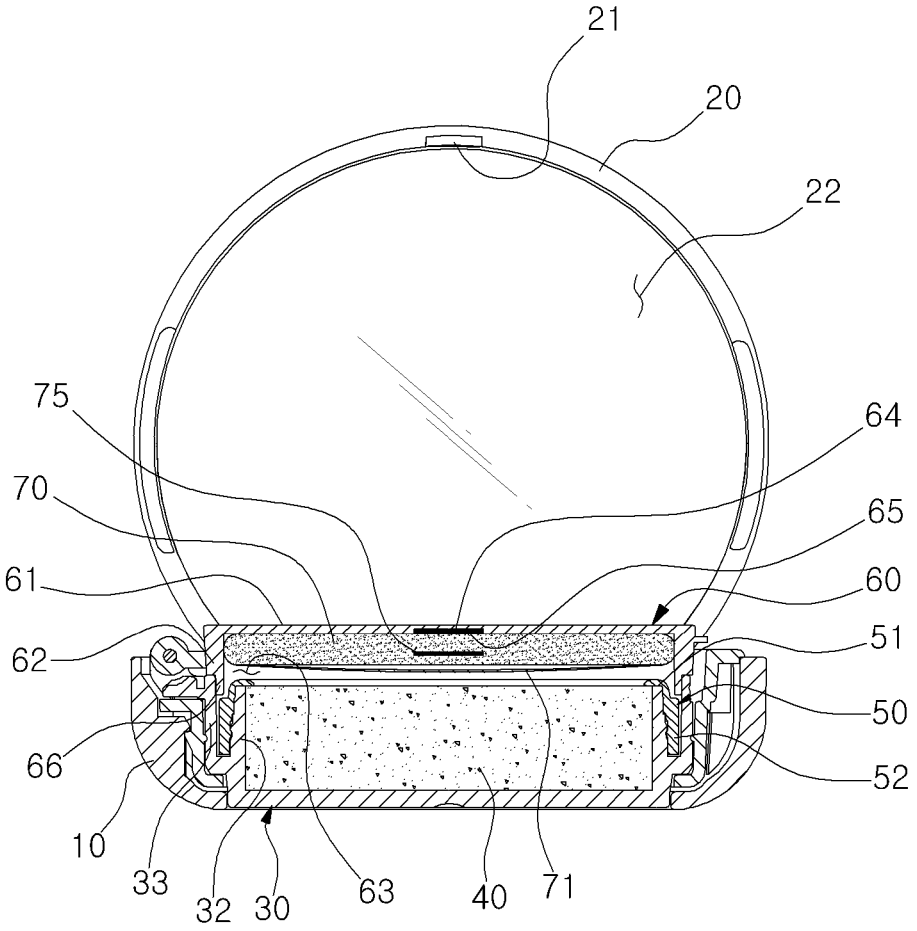
FIG. 4 is a sectional view showing the cosmetic container for preventing the mirror from being contaminated according to one embodiment of the present invention.
Figure 5:
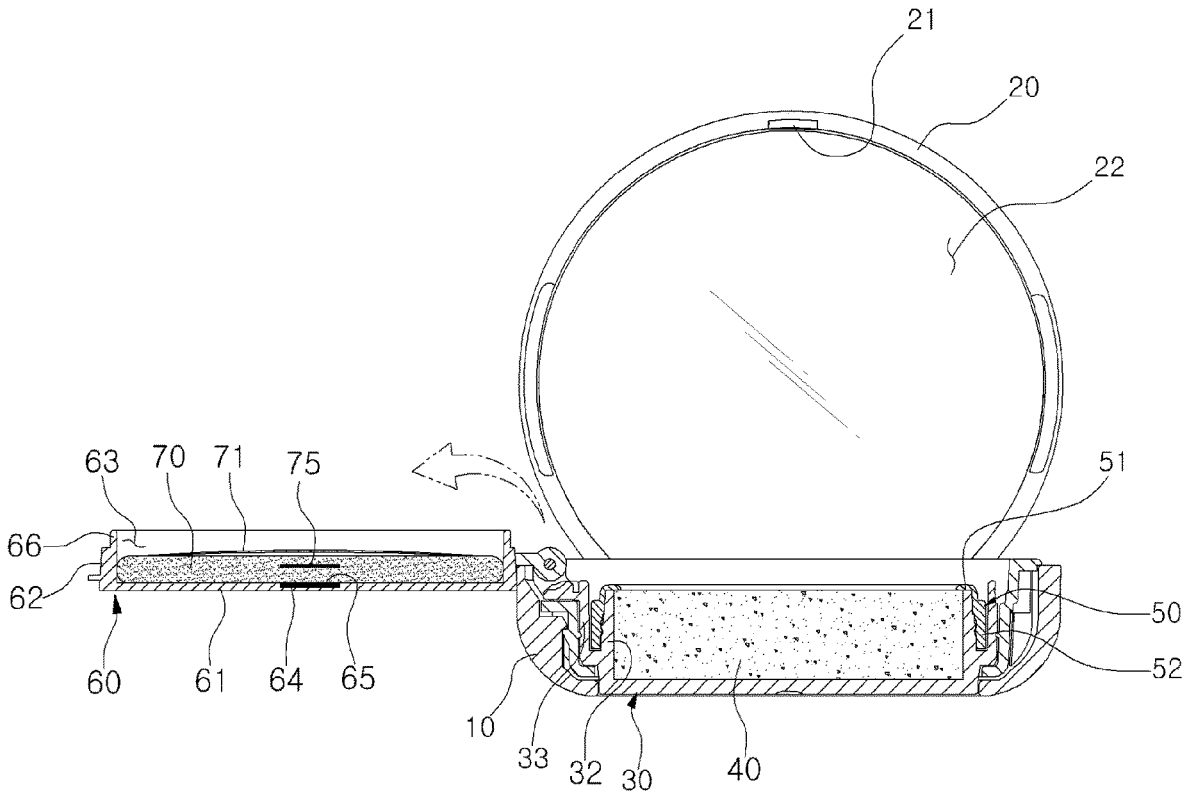
FIG. 5 is a sectional view showing that an inner container cover is open in the cosmetic container for preventing the mirror from being contaminated according to one embodiment of the present invention.
Figure 6:
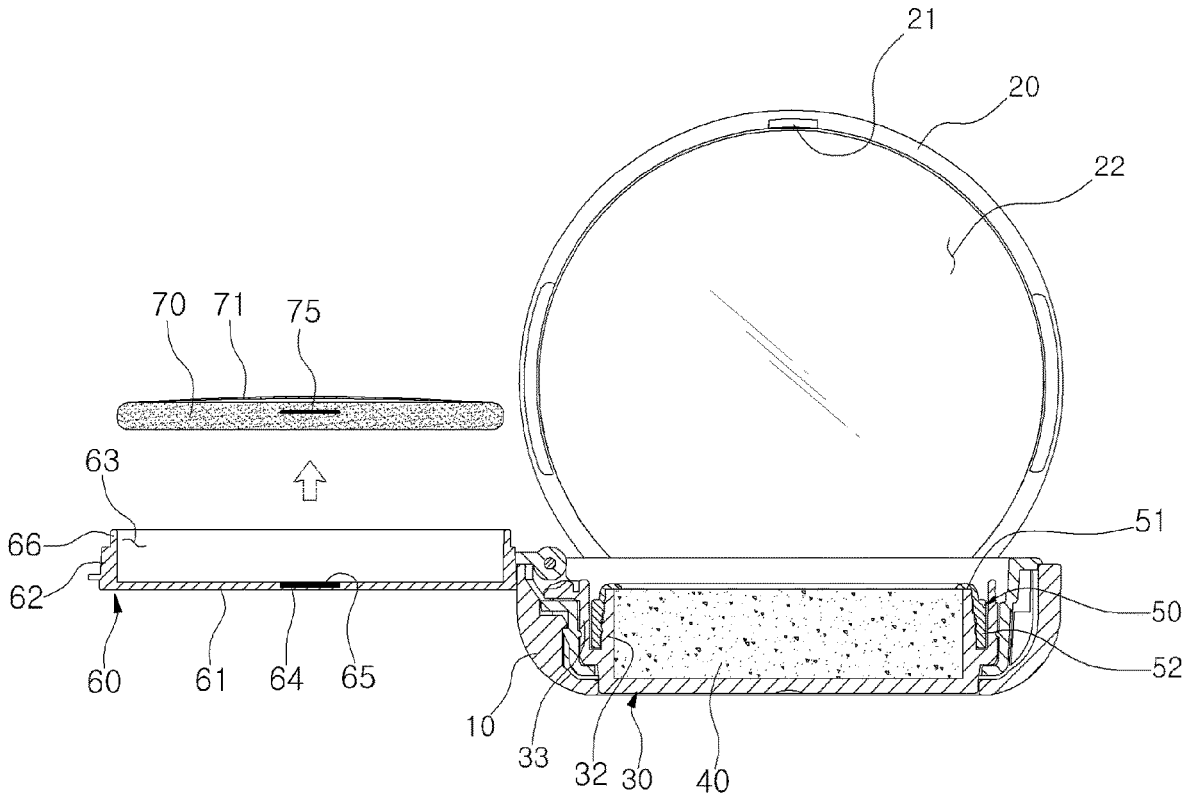
FIG. 6 is a sectional view showing that a puff is separated from the inner container cover in the cosmetic container for preventing the mirror from being contaminated according to one embodiment of the present invention.
Figure 7:
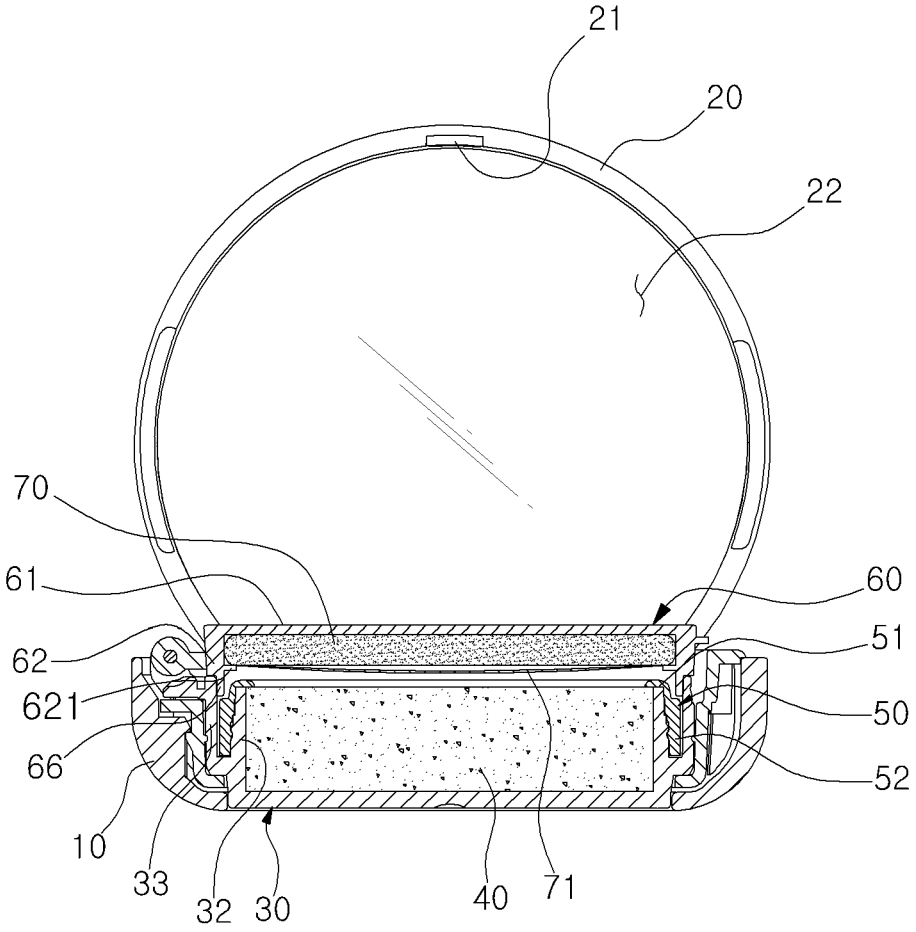
FIG. 7 is a sectional view showing a cosmetic container for preventing a mirror from being contaminated according to another embodiment of the present invention.
Figure 8:
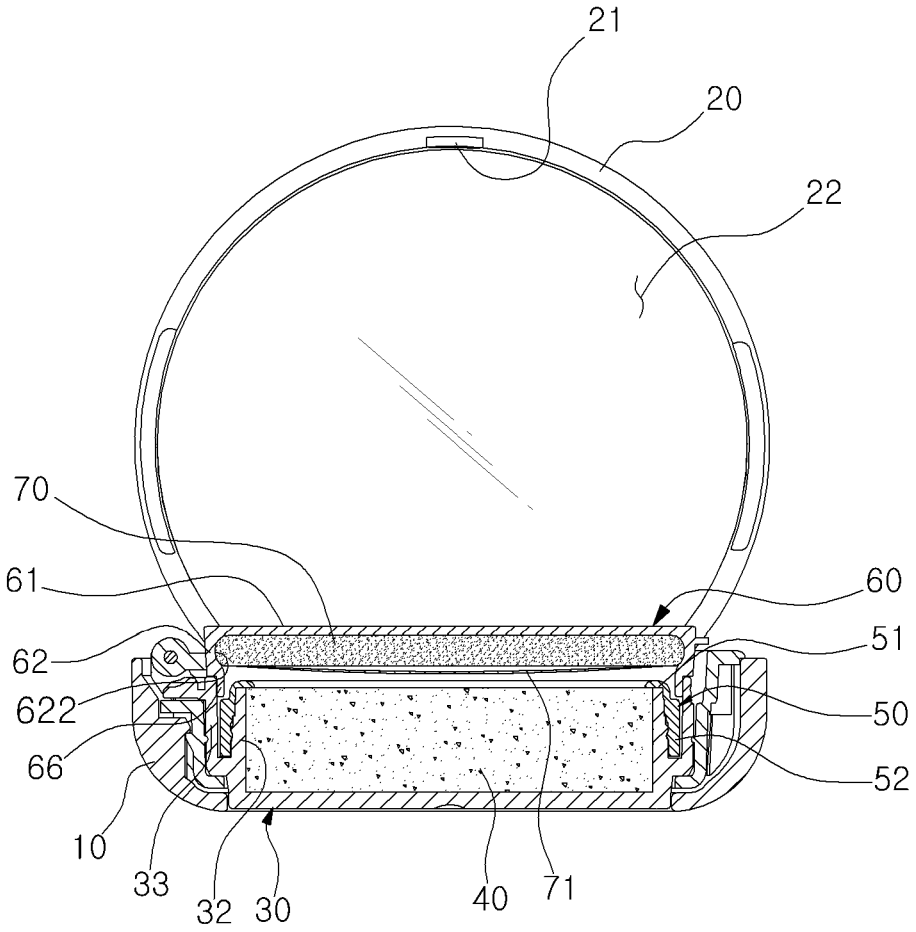
FIG. 8 is a sectional view showing a cosmetic container for preventing a mirror from being contaminated according to still another embodiment of the present invention.
Figure 9:
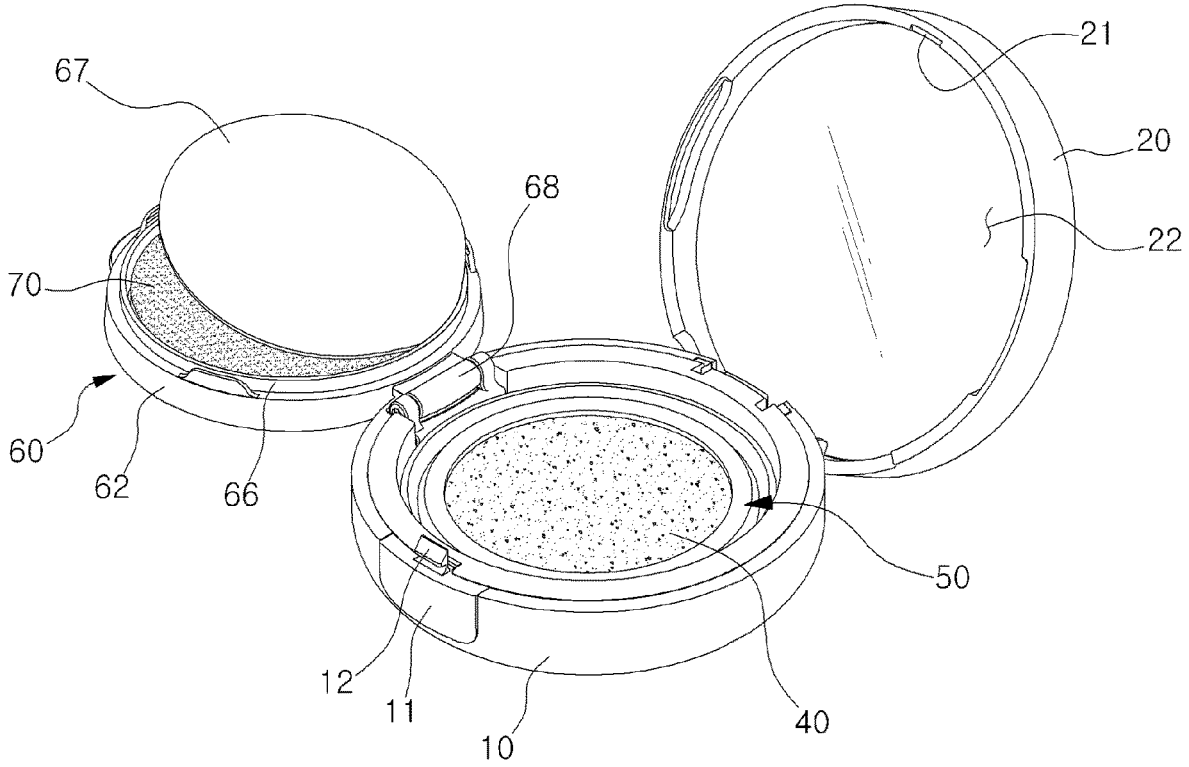
FIG. 9 is a perspective view showing that a membrane is formed at a lower end of the inner container cover in the cosmetic container for preventing the mirror from being contaminated according to one embodiment of the present invention.
Figure 10:
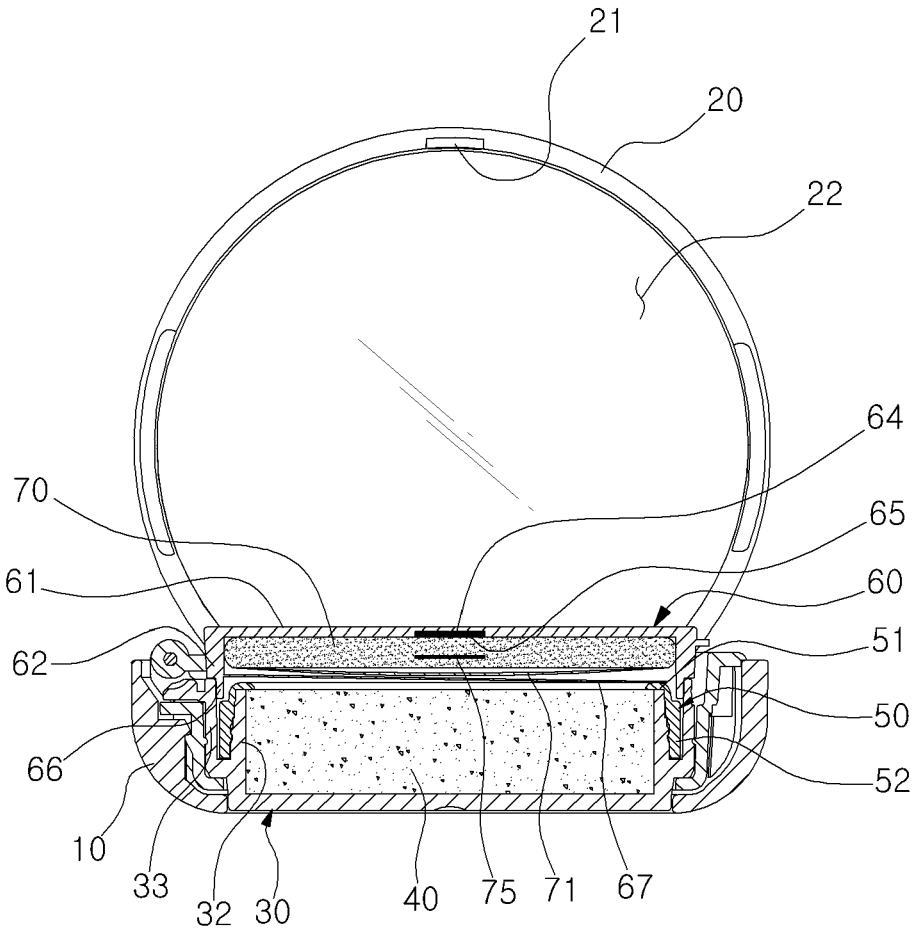
FIG. 10 is a perspective view showing that the membrane is formed at the lower end of the inner container cover in the cosmetic container for preventing the mirror from being contaminated according to one embodiment of the present invention.

FIG. 2 is a perspective view showing that a cover is open in a cosmetic container for preventing a mirror from being contaminated according to one embodiment of the present invention. FIG. 3 is an exploded perspective view showing the cosmetic container for preventing the mirror from being contaminated according to one embodiment of the present invention. FIG. 4 is a sectional view showing the cosmetic container for preventing the mirror from being contaminated according to one embodiment of the present invention. FIG. 5 is a sectional view showing that an inner container cover is open in the cosmetic container for preventing the mirror from being contaminated according to one embodiment of the present invention. FIG. 6 is a sectional view showing that a puff is separated from the inner container cover in the cosmetic container for preventing the mirror from being contaminated according to one embodiment of the present invention. FIG. 7 is a sectional view showing a cosmetic container for preventing a mirror from being contaminated according to another embodiment of the present invention. FIG. 8 is a sectional view showing a cosmetic container for preventing a mirror from being contaminated according to still another embodiment of the present invention. FIG. 9 is a perspective view showing that a membrane is formed at a lower end of the inner container cover in the cosmetic container for preventing the mirror from being contaminated according to one embodiment of the present invention. FIG. 10 is a perspective view showing that the membrane is formed at the lower end of the inner container cover in the cosmetic container for preventing the mirror from being contaminated according to one embodiment of the present invention.

The cosmetic container for preventing the mirror from being contaminated according to the present invention includes an outer container 10 having an open upper portion, an outer container cover 20 coupled to one side of the outer container 10 and having a mirror 22 attached to an inner side thereof, an inner container 30 mounted in the outer container 10, and an inner container cover 60 coupled to one side of the inner container 30 to seal the inner container 30. The inner container cover 60 has a puff receiving space 63 formed therein as a sidewall surface 62 integrally extends downward from an upper surface 61, a sealing member 66 extends downward from the sidewall surface 62, and a puff 70 is received in the puff receiving space 63.

The outer container 10 includes a pressing button 11 provided at one lateral side thereof with a locking step 12 and a hinge formed in opposition to the pressing button 11 so that the outer container 10 is hinged with the outer container cover 20. The outer container 10 is formed in an inner circumference thereof with a hinge bracket mounting hole 13.

In the pressing button 11, the locking step 12 extending from an upper portion of the pressing button 11 is easily retracted by the pressing operation of a user to be separated from a locking protrusion 21 of the outer container cover 20.

A hinge bracket 34 of the inner container 30 is inserted into the hinge bracket mounting hole 13.

The outer container cover 20 covers an upper portion of the outer container 10 and is hinged with the outer container 10 to open or close the outer container 10.

The outer container cover 20 is formed at one side thereof with the locking protrusion 21 corresponding to the lacking step 12 of the outer container 10.

A mirror 22 is coupled to an inner side of the outer container cover 20. The mirror 22 is to allow a user to conveniently use cosmetics received in the inner container 30 after opening the outer container cover 20.

The inner container 30 is mounted in the outer container 10, and includes a bottom surface 31, an inner wall 32 extending upward from the bottom surface 31, and an outer wall 33 placed at a predetermined distance outward from the inner wall 32.

A fixing member 50 is fitted around an outer circumferential surface of the inner wall 32 to be prevented from being separated from the inner container 30.

The hinge bracket 34 is formed on the outer circumference of the outer wall 33. A hinge block 68 formed on the inner container cover 60 is inserted into the hinge bracket 34 and then fixed by a hinge pin 35.

The inner container 30 is embedded therein with an impregnating member 40 into which cosmetics are impregnated, and the impregnating member 40 includes at least one selected from the group consisting of Butadiene Rubber (BR), Styrene Butadiene Rubber (SBR), Natural Rubber (NR), Natural Rubber Styrene Butadiene Rubber (NRSBR), Acrylonitrile-butadiene Rubber (NBR), wet polyurethane, dry polyurethane, polyether, polyester, polyvinyl chloride, polyethylene, latex, silicone, Polyvinyl Alcohol (PVA), nitrile rubber, butyl rubber, and neoprene.

The fixing member 50 is additionally coupled to the inner container 30, and includes a horizontally extending member 51 extending inward and a downward extending member 52 extending downward from the horizontally extending member 51.

The horizontally extending member 51 is mounted on an upper end of the inner wall 32 of the inner container 30 to prevent the impregnating member 40 from being separated from the inner container 30.

The downward extending member 52 is fitted around an outer circumference of the inner wall 32 of the inner container 30 to prevent the fixing member 50 from being separated from the inner container 30.

The inner container cover 60 is coupled to one side of the inner container 30 to open or close the inner container 30.

The inner container cover 60 includes the upper surface 61, the sidewall surface 62 extending downward from the upper surface 61, and the sealing member 66 extending downward from the sidewall surface 62.

The puff receiving space 63 is formed inside the sidewall surface 62, and the puff 70 is received in the puff receiving space 63.

As shown in FIG. 4, the puff receiving space 63 is formed in an upper end thereof with a magnet installation groove 64, and a magnet 65 is provided in the magnet installation groove 64.

The magnet 65 is coupled to a magnetic substance 75 embedded in the puff 70 to prevent the puff 70 from being separated from the puff receiving space 63.

As shown in FIGS. 7 and 8, the sidewall surface 62 of the inner container cover 60 is formed in the inside thereof with a fixing protrusion 621 or a fixing groove 622 to fix the puff 70 into the puff receiving space 63.

When the inner container cover 60 covers the inner container 30, the sealing member 66 is fitted into the inner circumferential surface of the outer wall 33 of the inner container 30 to increase the sealing of the inner container 30, thereby preventing cosmetics from being volatilized.

The hinge block 68, which is formed at one side of the inner container cover 60, is inserted into the hinge bracket 34 of the inner container 30 and then fixed by the hinge pin 35.

In addition, as shown in FIGS. 9 and 10, a membrane 67 is formed at a lower end of the puff receiving space 63 of the inner container cover 60 to prevent a strap 71 formed on the puff 70 from being in contact with the impregnating member 40 and contaminated.

The membrane 67 includes a film formed of a flexible material, and the film includes one of polyethylene phthalate (PET) or polyethylene, polypropylene, and elastomer.

The puff 70 received in the puff receiving space 63 of the inner container cover 60 has the strap 71 and is provided therein with the magnetic substance 75.

The magnetic substance 75 is coupled to the magnet 65 provided in the magnet installation groove 64 in the puff receiving space 63 to prevent the puff 70 from being separated from the puff receiving space 63 even if the puff 70 is directed downward as shown in FIG. 4.

The puff 70 is received in the inner container cover 60 having the sealing power, so that the cosmetics remaining on the puff 70 may be prevented from being hardened after the puff 70 has been used.

In addition, different from that of the related art, since the puff 70 is received in the puff receiving space 63 formed in the inner container cover 60, the puff 70 is stored separately from the mirror 22 so that the mirror 22 may be prevented from being contaminated.

Hereinafter, a method of assembling the cosmetic container for preventing a mirror from being contaminated according to one embodiment of the present invention and the use state thereof will be described in detail.

In order to assemble the cosmetic container for preventing a mirror from being contaminated according to the present invention, the outer container cover 20 having the mirror 22 attached thereto is coupled to the outer container 10 having the pressing button 11.

In addition, the inner container cover 60 is coupled to the inner container 30, in which the inner container cover 60 is formed therein with the puff receiving space 63.

Thereafter, the puff 70 is received in the puff receiving space 63. In this case, the magnet 65 is provided in the puff receiving space 63, the magnetic substance 75 is embedded in the puff 70, and the magnet 65 is mutually coupled to the magnetic substance 75.

The impregnating member 40 having cosmetics impregnated therein is provided in the inner container 30 coupled to the inner container cover 60.

After coupling the fixing member 50 to the inner container 30 having the impregnating member 40, the inner container 30 is coupled to the inside of the outer container 10 to complete the assembly.

In order to use the cosmetic container for preventing the mirror from being contaminated, which is assembled through the above method, the inner container cover 60 is open as shown in FIG. 5.

When the inner container cover 60 is open, the puff 70 received in the puff receiving space 63 appears.

Thereafter, as shown in FIG. 6, a user uses the puff 70 by separating the puff 70 from the puff receiving space 63 in the inner container cover 60.

According to the present invention, since the puff 70 is placed inside the inner container cover 60 not to make contact with the mirror 22 coupled to the inside of the outer container cover 20, the mirror 22 may be prevented from being contaminated.

In addition, since the inside of the inner container cover 60 is sealed, the cosmetics remaining on the puff 70 may be prevented from being hardened after the puff 70 has been used.

As described above, although a cosmetic container for preventing a mirror from being contaminated according to one embodiment of the present invention has been described for the illustrative purpose, the present invention is not limited thereto. Thus, it should be understood that numerous other modifications and embodiments can be devised by those skilled in the art within the spirit and scope of the present invention and they will fall within the scope of the present invention.

DESCRIPTION OF REFERENCE NUMERALS

10: Outer container
11: Pressing button
12: Locking step
13: Hinge bracket
20: Outer container cower
21: Locking protrusion
22: Mirror
30: Inner container
31: Bottom surface
32: Inner wall
33: Outer wall
34: Hinge bracket
35: Hinge pin
40: Impregnating member
50: Fixing member
51: Horizontally extending member
52: Downward extension member
60: Inner container cover
61: Upper surface
62: Sidewall surface
621: Fixing protrusion
622: Fixing groove
63: Puff receiving space
64: Magnet installation groove
65: Magnet
66: Sealing member
67: Membrane
68: Hinge block
70: Puff
71: Strap
75: Magnetic substance

The invention claimed is:

1. A cosmetic container for preventing a mirror from being contaminated, the cosmetic container comprising:

an outer container (10) having an open upper portion;

an outer container cover (20) coupled to one side of the outer container (10) and having a mirror (22) attached to an inner side thereof;

an inner container (30) mounted in the outer container (10); and an inner container cover (60) coupled to one side of the inner container (30) to seal the inner container (30), wherein the inner container cover (60) has a puff receiving space (63) formed therein by a sidewall surface (62) integrally extending downward from an upper surface (61) such that, when the inner container cover (60) covers the inner container (30), the upper surface (61) is disposed between the puff receiving space (63) and the mirror (22), a sealing member (66) extends downward from the sidewall surface (62) such that, when the inner container cover (60) covers the inner container (30), the sealing member (66) is fitted against an inner circumferential surface of an outer wall (33) of the inner container (30), and a puff (70) is received in the puff receiving space (63) such that, when the inner container cover (60) covers the inner container (30), the puff (70) is sealed between the inner container cover (60) and the inner container (30) to prevent hardening of cosmetic material on the puff (70), wherein the puff (70) is received in the inner container cover (60) having the sealing power, and a magnet (65) is provided in the puff receiving space (63) of the inner container cover (60) and a magnetic substance (75) is provided in the puff (70) such that the puff (70) is attached to the puff receiving space (63).

2. The cosmetic container of claim 1, wherein the inner container (30) is provided therein with an impregnating member (40).

3. The cosmetic container of claim 1, further comprising a fixing member (50) provided on the inner container (30) to prevent an impregnating member (40) from being separated out of the inner container (30).

4. The cosmetic container of claim 1, wherein the sidewall surface (62) of the inner container cover (60) is formed in an inner side thereof with a fixing protrusion (621) or a fixing groove (622) to fixedly store the puff (70).

5. The cosmetic container of claim 1, wherein a membrane (67) is formed at a lower end of the puff receiving space (63) of the inner container cover (60) to prevent a strap (71) formed on the puff (70) from being in contact with an impregnating member (40) and contaminated.

* * * * *